US010371161B2

(12) United States Patent
Ling et al.

(10) Patent No.: US 10,371,161 B2
(45) Date of Patent: Aug. 6, 2019

(54) IMPELLER AND CENTRIFUGAL FAN WITH SAME

(71) Applicant: DELTA ELECTRONICS, INC., Taoyuan (TW)

(72) Inventors: Wei-I Ling, Taoyuan (TW); Chih-Chung Chen, Taoyuan (TW); Meng-Yu Chen, Taoyuan (TW)

(73) Assignee: DELTA ELECTRONICS, INC, Taoyuan (TW)

( * ) Notice: Subject to any disclaimer, the term of this patent is extended or adjusted under 35 U.S.C. 154(b) by 371 days.

(21) Appl. No.: 15/346,405

(22) Filed: Nov. 8, 2016

(65) Prior Publication Data

US 2017/0298950 A1 Oct. 19, 2017

Related U.S. Application Data

(60) Provisional application No. 62/323,113, filed on Apr. 15, 2016.

(30) Foreign Application Priority Data

Jul. 29, 2016 (CN) ..... 2016 1 0616518

(51) Int. Cl.

| | |
|---|---|
| ***F04D 17/16*** | (2006.01) |
| ***F04D 29/28*** | (2006.01) |
| ***F04D 29/30*** | (2006.01) |
| ***F04D 29/42*** | (2006.01) |
| ***F04D 29/66*** | (2006.01) |

(52) U.S. Cl.

CPC ..... *F04D 29/281* (2013.01); *F04D 17/16* (2013.01); *F04D 29/30* (2013.01); *F04D 29/4226* (2013.01); *F04D 29/666* (2013.01)

(58) Field of Classification Search

CPC ..... F04D 29/682; F04D 29/30; F04D 29/666

See application file for complete search history.

(56) References Cited

U.S. PATENT DOCUMENTS

| | | | | |
|---|---|---|---|---|
| 4,653,976 | A * | 3/1987 | Blair | F01D 5/045 415/1 |
| 6,589,013 | B2 * | 7/2003 | Abdallah | F04D 17/127 415/199.2 |
| 7,607,886 | B2 * | 10/2009 | Hsu | F04D 29/281 415/206 |
| 8,029,237 | B2 * | 10/2011 | Chang | F04D 29/4226 415/206 |

FOREIGN PATENT DOCUMENTS

| | | | |
|---|---|---|---|
| CN | 1614241 | A | 5/2005 |
| CN | 1721709 | A | 1/2006 |
| GB | 2090338 | A | 7/1982 |
| TW | 200902853 | A | 1/2009 |
| TW | I314183 | B | 9/2009 |

* cited by examiner

*Primary Examiner* — Ninh H. Nguyen

(74) *Attorney, Agent, or Firm* — Kirton McConkie; Evan R. Witt

(57) ABSTRACT

A centrifugal fan includes a frame and an impeller. The impeller is disposed within the frame. The impeller includes a hub, a first blade group and a second blade group. The hub includes a center part, an inclined part and a connection part. The first blade group is connected with the connection part of the hub. The second blade group is disposed on the inclined part of the hub. There is a first distance between the second blade group and the first blade group. There is a second distance between the second blade group and the center part of the hub.

16 Claims, 4 Drawing Sheets

IMPELLER AND CENTRIFUGAL FAN WITH SAME

CROSS-REFERENCE TO RELATED APPLICATION

This application claims the benefit of U.S. Provisional Application No. 62/323,113, filed on Apr. 15, 2016, and entitled "CENTRIFUGAL FAN WITH DUAL IMPELLER", the entirety of which is hereby incorporated by reference.

FIELD OF THE INVENTION

The present invention relates to an impeller and a centrifugal fan employing the same, and more particularly to an impeller with two blade groups and suitably used in the high system impedance condition. The present invention also relates to a centrifugal fan employing the impeller.

BACKGROUND OF THE INVENTION

With increasing development of science and technology, the performance of electronic devices is largely enhanced. Consequently, heat dissipating devices or heat dissipating systems become essential instruments for the electronic devices. During operation of an electronic device, a great amount of heat is generated by the electronic components of the electronic device. If the heat cannot be effectively dissipated away, the elevated operating temperature may result in damage, short circuit or deteriorated performance of the electronic device. For effectively removing the heat, it is important to install a high-performance heat dissipating device within or beside the electronic device to exhaust the heat to the surroundings. Moreover, the manufactures make efforts in increasing the efficiency of the heat dissipating device.

A fan is one of the most popular heat dissipating devices. As the performance of the electronic device is enhanced, it is important to increase the heat dissipating efficiency of the fan. For example, the increase of the channel within a frame of the fan can increase the amount of the produced airflow. However, in case that the channel is enlarged, the volume of the fan is also increased. Since the layout space of the electronic device is limited, it is difficult to install the large fan in the electronic device.

Moreover, the impeller of the conventional centrifugal fan is usually equipped with a single blade group. For increasing the amount of the produced airflow, it is necessary to increase the rotating speed. As the rotating speed is increased, the problem of generating noise becomes more serious. In accordance with another approach, the centrifugal fan is equipped with two impellers to increase the airflow amount. Each of the two impellers has a blade group, and the two blade groups of the two impellers are interlaced and assembled with each other. That is, the overall volume of the fan is also increased. Since the layout space of the electronic device is limited, it is difficult to install the large fan in the electronic device.

Therefore, there is a need of providing an impeller and a centrifugal fan with enhanced operating efficiency, reduced system impedance and reduced noise in order to overcome the drawbacks of the conventional technology.

SUMMARY OF THE INVENTION

An object of the present invention provides an impeller and a centrifugal fan with enhanced operating efficiency, reduced system impedance and reduced noise.

Another object of the present invention provides an impeller with a first blade group and a second blade group. The first blade group and the second blade group are disposed on a hub of the impeller. Consequently, the overall performance of the centrifugal fan is enhanced, the system impedance is reduced and the noise is reduced. Moreover, the overall volume of a centrifugal fan with the impeller is not increased.

In accordance with an aspect of the present invention, there is provided an impeller. The impeller includes a hub, a first blade group and a second blade group. The hub includes a center part, an inclined part and a connection part. The first blade group is connected with the connection part of the hub. The second blade group is disposed on the inclined part of the hub. There is a first distance between the second blade group and the first blade group. There is a second distance between the second blade group and the center part of the hub.

In an embodiment, the inclined part is arranged between the center part and the connection part, and the inclined part has an incline that is extended downwardly from the center part to the connection part. An end of the inclined part is connected with the connection part.

In an embodiment, the first distance is in a range between 3 mm and 4 mm, and the second distance is in a range between 3 mm and 4 mm.

In an embodiment, the first distance is equal to the second distance, and both of the first distance and the second distance are 3.5 mm.

In an embodiment, the second blade group is integrally formed with the hub, and the second blade group is protruded upwardly from the inclined part of the hub.

In an embodiment, the first blade group includes plural forwardly-inclined blades, and the second blade group includes plural backwardly-inclined blades.

In an embodiment, a blade density of the plural forwardly-inclined blades of the first blade group is larger than a blade density of the plural backwardly-inclined blade of the second blade group.

In an embodiment, a gap between every two adjacent forwardly-inclined blades of the first blade group is in a range between 8 mm and 12 mm, and a gap between every two adjacent backwardly-inclined blades of the second blade group is in a range between 22 mm and 26 mm.

In an embodiment, the gap between every two adjacent forwardly-inclined blades of the first blade group is 10 mm, and the gap between every two adjacent backwardly-inclined blades of the second blade group is 24 mm.

In an embodiment, a height of the second blade group is smaller than a height of the first blade group.

In an embodiment, the height of the first blade group is in a range between 13 mm and 14 mm, and the height of the second blade group is in a range between 11 mm and 12 mm.

In an embodiment, the height of the first blade group is 13.4 mm, and the height of the second blade group is 11.4 mm.

In an embodiment, there is a height difference between the first blade group and the second blade group, and the height difference is in a range between 1 mm and 3 mm.

In an embodiment, the height difference is 2 mm.

In accordance with another aspect of the present invention, there is provided a centrifugal fan. The centrifugal fan includes a frame and an impeller. The impeller is disposed within the frame. The impeller includes a hub, a first blade group and a second blade group. The hub includes a center part, an inclined part and a connection part. The first blade group is connected with the connection part of the hub. The second blade group is disposed on the inclined part of the hub. There is a first distance between the second blade group and the first blade group. There is a second distance between the second blade group and the center part of the hub.

In an embodiment, the second blade group is integrally formed with the hub, and the second blade group is protruded upwardly from the inclined part of the hub.

In an embodiment, the first blade group includes plural forwardly-inclined blades, and the second blade group includes plural backwardly-inclined blades. A blade density of the plural forwardly-inclined blades of the first blade group is larger than a blade density of the plural backwardly-inclined blade of the second blade group.

In an embodiment, a height of the second blade group is smaller than a height of the first blade group.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
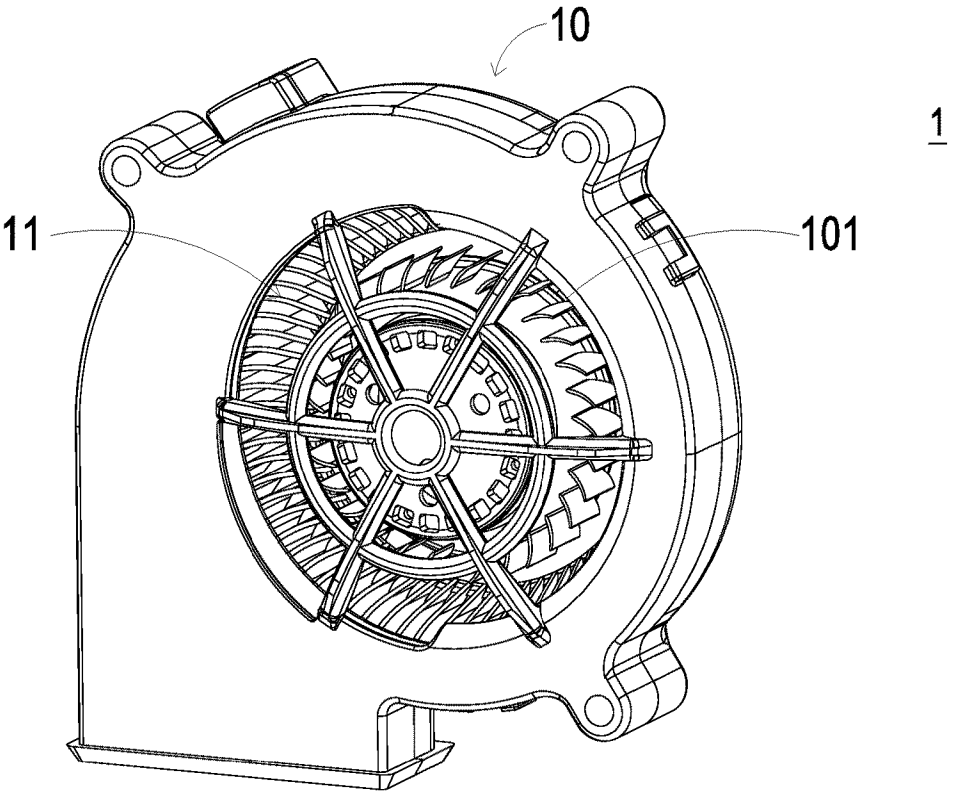
FIG. 1 is a schematic perspective view illustrating the outer appearance of a centrifugal fan according to an embodiment of the present invention.
Figure 2:
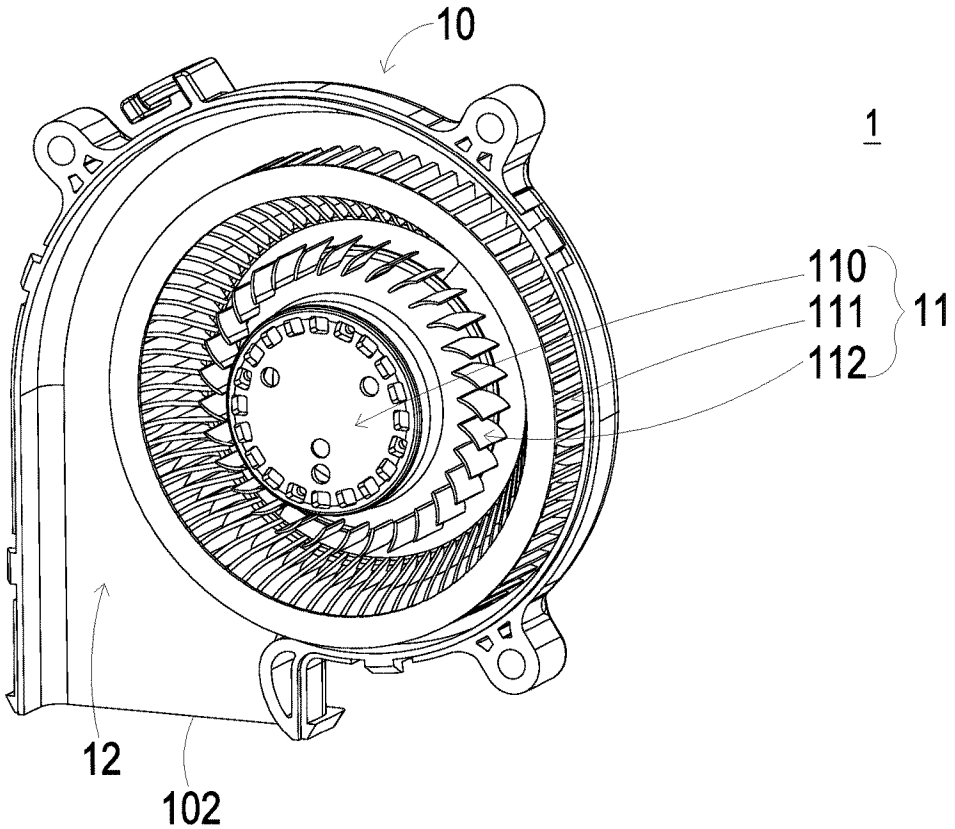
FIG. 2 is a schematic perspective view illustrating the inner structure of the centrifugal fan of FIG. 1.

FIG. 1 is a schematic perspective view illustrating the outer appearance of a centrifugal fan according to an embodiment of the present invention. FIG. 2 is a schematic perspective view illustrating the inner structure of the centrifugal fan of FIG. 1. As shown in FIGS. 1 and 2, the fan is a centrifugal fan 1. The centrifugal fan 1 comprises a frame 10 and an impeller 11. The impeller 11 is disposed within the frame 10. The frame 10 has an inlet 101 and an outlet 102. During operation of the centrifugal fan 1, the ambient airflow is inhaled into the inlet 101, driven to a channel 12 by the impeller 11 and exited from the outlet 102.

As shown in FIG. 2, the impeller 11 comprises a hub 110, a first blade group 111 and a second blade group 112. The blades of the first blade group 111 are disposed on a periphery region of the hub 12. The blades of the second blade group 112 are disposed on the hub 12. In addition, a motor (not shown) is installed within the hub 110 for providing motive power to the centrifugal fan 1. As the hub 110 is driven to rotate by the motor, the blades of the first blade group 111 and the blades of the second blade group 112 are synchronously rotated to increase the speed of inhaling the airflow. Moreover, the airflow is exited from the outlet 102 through the channel 12.

Figure 3A:
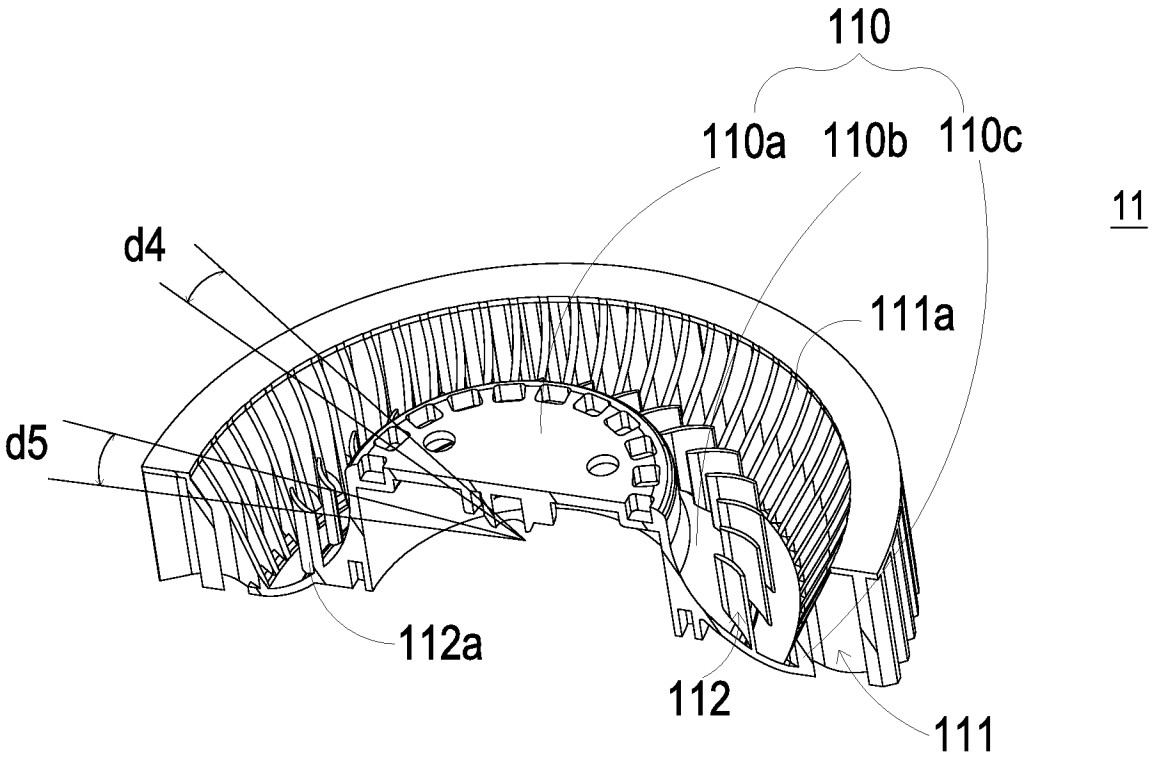
FIG. 3A is a schematic cutaway view illustrating the impeller of the centrifugal fan as shown in FIG. 2.

FIG. 3A is a schematic cutaway view illustrating the impeller of the centrifugal fan as shown in FIG. 2. As shown in FIG. 3A, the hub 110 comprises a center part 110*a*, an inclined part 110*b* and a connection part 110*c*. In this embodiment, the hub 110 is a disk-type structure. The center part 110*a* is located at the center position of the hub 110. The motor (not shown) is disposed under the center part 110*a*. The center part 110*a* is cup-shaped. The inclined part 110*b* is arranged between the center part 110*a* and the connection part 110*c*. Moreover, the inclined part 110*b* has an incline that is extended downwardly from the center part 110*a* to the connection part 110*c*. An end of the inclined part 110*b* is connected with the connection part 110*c*. The connection part 110*c* is connected with the first blade group 111. In an embodiment, the first blade group 111 is assembled with the hub 110 through the connection part 110*c* by engagement. In another embodiment, the first blade group 111 is integrally formed with the connection part 110*c*. That is, the way of connecting the first blade group 111 and the connection part 110*c* is not limited to the above embodiment and may be varied according to the practical requirements. The second blade group 112 is disposed on the inclined part 110*b*. Preferably, the second blade group 112 is integrally formed with the inclined part 110*b* of the hub 110. Moreover, the second blade group 112 is protruded upwardly from the inclined part 110*b*.

Figure 3B:
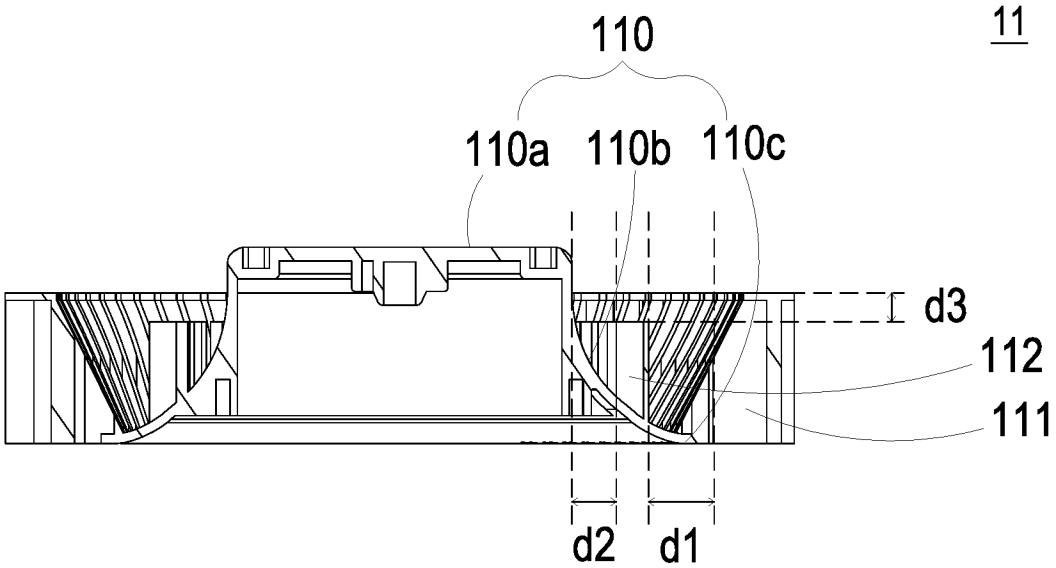
FIG. 3B is a schematic cross-sectional view illustrating the impeller of FIG. 3A.

FIG. 3B is a schematic cross-sectional view illustrating the impeller of FIG. 3A. The operating principle of the centrifugal fan 1 will be described with reference to FIGS. 3A and 3B.

Please refer to FIG. 3A. The blades of the first blade group 111 are disposed on the periphery region of the hub 110. Moreover, the first blade group 111 comprises plural forwardly-inclined blades 111*a*. The blades of the second blade group 112 are disposed on the inclined part 110*b* of the hub 110. Moreover, the second blade group 112 comprises plural backwardly-inclined blades 112*a*. That is, the forwardly-inclined blades 111*a* of the first blade group 111 and the backwardly-inclined blades 112*a* of the second blade group 112 are inclined in opposite directions. The backwardly-inclined blades 112*a* of the second blade group 112 can increase the impedance of the centrifugal fan 1.

Please refer to FIG. 3B. There is a first distance d1 between the rear edge of the backwardly-inclined blade 112*a* of the second blade group 112 and the front edge of the forwardly-inclined blade 111*a* of the first blade group 111. That is, the second blade group 112 is separated from the first blade group 111, and the blades of the second blade group 112 and the blades of the first blade group 111 are not interlaced. Moreover, there is a second distance d2 between the front edge of the backwardly-inclined blade 112*a* of the second blade group 112 and the edge of the center part 110*a* of the hub 110. That is, the second blade group 112 is separated from the center part 110*a* of the hub 110. In this embodiment, the second blade group 112 is separated from the center part 110*a* of the hub 110, and the second blade group 112 is separated from the first blade group 111. In an embodiment, the first distance d1 is equal to the second distance d2. For example, both of the first distance d1 and the second distance d2 are in the range between 3 mm and 4 mm. Preferably, both of the first distance d1 and the second distance d2 are 3.5 mm.

Please refer to FIG. 3A again. In this embodiment, the blade density of the forwardly-inclined blades 111*a* of the first blade group 111 is larger than the blade density of the backwardly-inclined blades 112*a* of the second blade group 112. For example, the first blade group 111 comprises 71 forwardly-inclined blades 111*a*, and the second blade group 112 comprises 31 backwardly-inclined blades 112*a*. Since the forwardly-inclined blades 111*a* of the first blade group 111 are densely arranged, the noise is reduced. Moreover, since the backwardly-inclined blades 112*a* of the second blade group 112 are inclined in the opposite direction, the impedance of the centrifugal fan 1 is increased and the overall performance of the centrifugal fan 1 is enhanced. Moreover, a gap d4 between every two adjacent forwardly-inclined blades 111*a* of the first blade group 111 is in the range between 8 mm and 12 mm, and preferably 10 mm. Moreover, a gap d5 between every two adjacent backwardly-inclined blades 112*a* of the second blade group 112 is in the range between 22 mm and 26 mm, and preferably 24 mm.

Please refer to FIG. 3B again. In this embodiment, the height of the center part 110*a* of the hub 110 is larger than the height of the first blade group 111 and the height of the second blade group 112. Moreover, the height of the first blade group 111 is larger than the height of the second blade group 112. In an embodiment, the height of the first blade group 111 is in the range between 13 mm and 14 mm, and preferably 13.4 mm. Moreover, the height of the second blade group 112 is in the range between 11 mm and 12 mm, and preferably 11.4 mm. There is a height difference d3 between the first blade group 111 and the second blade group 112. The height difference d3 is in the range between 1 mm and 3 mm, and preferably 2 mm.

From the above descriptions, the present invention provides an impeller and a centrifugal fan with the impeller. The impeller of the present invention is specially designed. The second blade group is integrally formed with the inclined part of the hub in order to increase the impedance of the centrifugal fan and reduce the system impedance. Consequently, the centrifugal fan is suitably used in the high system impedance condition. Moreover, since the forwardly-inclined blades of the first blade group are densely arranged, the noise is reduced. More especially, the layout space of the centrifugal fan is not increased. Consequently, the overall performance of the centrifugal fan is enhanced, the system impedance is reduced and the noise is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An impeller, comprising:

a hub comprising a center part, an inclined part and a connection part;

a first blade group connected with the connection part of the hub; and a second blade group disposed on the inclined part of the hub, wherein the second blade group is integrally formed with the hub, the second blade group is protruded upwardly from the inclined part of the hub, there is a first distance between the second blade group and the first blade group, and there is a second distance between the second blade group and the center part of the hub.

2. The impeller according to claim 1, wherein the inclined part is arranged between the center part and the connection part, and the inclined part has an incline that is extended downwardly from the center part to the connection part, and an end of the inclined part is connected with the connection part.

3. The impeller according to claim 1, wherein the first distance is in a range between 3 mm and 4 mm, and the second distance is in a range between 3 mm and 4 mm.

4. The impeller according to claim 1, wherein the first distance is equal to the second distance, and both of the first distance and the second distance are 3.5 mm.

5. An impeller, comprising:

a hub comprising a center part, an inclined part and a connection part;

a first blade group connected with the connection part of the hub, wherein the first blade group comprises plural forwardly-inclined blades, and a second blade group disposed on the inclined part of the hub, wherein the second blade group comprises plural backwardly-inclined blades, there is a first distance between the second blade group and the first blade group, and there is a second distance between the second blade group and the center part of the hub.

6. The impeller according to claim 5, wherein a blade density of the plural forwardly-inclined blades of the first blade group is larger than a blade density of the plural backwardly-inclined blade of the second blade group.

7. The impeller according to claim 6, wherein a gap between every two adjacent forwardly-inclined blades of the first blade group is in a range between 8 mm and 12 mm, and a gap between every two adjacent backwardly-inclined blades of the second blade group is in a range between 22 mm and 26 mm.

8. The impeller according to claim 7, wherein the gap between every two adjacent forwardly-inclined blades of the first blade group is 10 mm, and the gap between every two adjacent backwardly-inclined blades of the second blade group is 24 mm.

9. The impeller according to claim 5, wherein a height of the second blade group is smaller than a height of the first blade group.

10. The impeller according to claim 9, wherein the height of the first blade group is in a range between 13 mm and 14 mm, and the height of the second blade group is in a range between 11 mm and 12 mm.

11. The impeller according to claim 10, wherein the height of the first blade group is 13.4 mm, and the height of the second blade group is 11.4 mm.

12. The impeller according to claim 9, wherein there is a height difference between the first blade group and the second blade group, and the height difference is in a range between 1 mm and 3 mm.

13. The impeller according to claim 12, wherein the height difference is 2 mm.

14. A centrifugal fan, comprising:

a frame; and an impeller disposed within the frame, wherein the impeller comprises:

a hub comprising a center part, an inclined part and a connection part;

a first blade group connected with the connection part of the hub; and a second blade group disposed on the inclined part of the hub, wherein the second blade group is integrally formed with the hub, and the second blade group is protruded upwardly from the inclined part of the hub, there is a first distance between the second blade group and the first blade group, and there is a second distance between the second blade group and the center part of the hub.

15. A centrifugal fan, comprising:

a frame, and an impeller disposed within the frame, wherein the impeller comprises:

a hub comprising a center part, an inclined part and a connection part, a first blade group connected with the connection part of the hub, wherein the first blade group comprises plural forwardly-inclined blades; and a second blade group disposed on the inclined part of the hub, wherein there is a first distance between the second blade group and the first blade group, there is a second distance between the second blade group and the center part of the hub, the second blade group comprises plural backwardly-inclined blades, wherein a blade density of the plural forwardly-inclined blades of the first blade group is larger than a blade density of the plural backwardly-inclined blade of the second blade group.

16. The centrifugal fan according to claim 15, wherein a height of the second blade group is smaller than a height of the first blade group.

* * * * *